US011840899B2

(12) United States Patent
Karlsen et al.

(10) Patent No.: US 11,840,899 B2
(45) Date of Patent: Dec. 12, 2023

(54) WELL ABANDONMENT AND SLOT RECOVERY

(71) Applicant: Ardyne Holdings Limited, Aberdeen (GB)

(72) Inventors: Hans Christian Karlsen, Trondheim (NO); Eskild Storteig, Rognan (NO); Steffen Hansen, Aberdeen (GB); Michael Wardley, Aberdeen (GB); James Linklater, Aberdeen (GB)

(73) Assignee: ARDYNE HOLDINGS LIMITED, Aberdeen (GB)

( * ) Notice: Subject to any disclaimer, the term of this patent is extended or adjusted under 35 U.S.C. 154(b) by 271 days.

(21) Appl. No.: 17/427,703

(22) PCT Filed: Feb. 13, 2020

(86) PCT No.: PCT/EP2020/053796

§ 371 (c)(1),
(2) Date: Aug. 2, 2021

(87) PCT Pub. No.: WO2020/165364

PCT Pub. Date: Aug. 20, 2020

(65) Prior Publication Data

US 2022/0145718 A1 May 12, 2022

(30) Foreign Application Priority Data

Feb. 14, 2019 (GB) ..... 1902058

(51) Int. Cl.
*E21B 31/00* (2006.01)
*E21B 28/00* (2006.01)
*E21B 31/20* (2006.01)

(52) U.S. Cl.
CPC ..... *E21B 31/005* (2013.01); *E21B 28/00* (2013.01); *E21B 31/20* (2013.01)

(58) Field of Classification Search
CPC ..... E21B 31/005; E21B 28/00; E21B 31/20
See application file for complete search history.

(56) References Cited

U.S. PATENT DOCUMENTS 2,350,212 A 5/1944 Bodine, Jr.
2,700,422 A * 1/1955 Bodine, Jr. ..... E21B 28/00 166/249

(Continued)

FOREIGN PATENT DOCUMENTS

GB 2562089 A 11/2018
WO WO 97/44565 11/1997

(Continued)

OTHER PUBLICATIONS

Intellectual Property Office of the UK Patent Office; Search Report for GB1902058.5; one page; dated Jun. 12, 2019; Intellectual Property Office of the UK Patent Office, Newport, South Wales, United Kingdom.

(Continued)

*Primary Examiner* — Shane Bomar
(74) *Attorney, Agent, or Firm* — LAW OFFICE OF JESSE D. LAMBERT, LLC

(57) ABSTRACT

A method of recovering casing in a wellbore using a vibratory casing recovery bottom hole assembly. In a vibratory casing recovery bottom hole assembly having a casing spear, a flow modifier and one or more further elements including a shock sub. The flow modifier produces cyclic variations in fluid flow through the assembly at a first frequency and at least one of the elements is configured to have a natural or resonant frequency when vibrated to be near or at the first frequency. By tuning elements of the bottom hole assembly to be close or at the frequency of the output of the flow modifier, the dynamic amplification factor of the system is maximised and longer lengths of casing can be recovered. A method of recovering casing using the (Continued)

vibratory casing recovery bottom hole assembly is also described. Further embodiments include a casing cutter and a hydraulic jack.

9 Claims, 3 Drawing Sheets

(56) References Cited

U.S. PATENT DOCUMENTS

| | | | | |
|---|---|---|---|---|
| 2,972,380 | A * | 2/1961 | Bodine, Jr. | E21B 31/005 166/301 |
| 4,236,580 | A * | 12/1980 | Bodine | E21B 31/005 166/301 |
| 4,673,037 | A * | 6/1987 | Bodine | E21B 31/005 166/177.2 |
| 4,815,328 | A | 3/1989 | Bodine | |
| 4,890,682 | A * | 1/1990 | Worrall | E21B 31/113 175/298 |
| 6,009,948 | A | 1/2000 | Flanders et al. | |
| 6,279,670 | B1 | 8/2001 | Eddison | |
| 7,077,205 | B2 | 7/2006 | Eddison | |
| 8,365,826 | B2 | 2/2013 | Braddick | |
| 9,222,312 | B2 * | 12/2015 | Anderson | E21B 7/24 |
| 9,605,484 | B2 * | 3/2017 | Gillis | E21B 44/00 |
| 2002/0155758 | A1 | 10/2002 | Wang et al. | |
| 2004/0011564 | A1 | 1/2004 | Eddison | |
| 2017/0016305 | A1 * | 1/2017 | Prieur | E21B 28/00 |
| 2017/0254184 | A1 * | 9/2017 | Comsa | E21B 7/24 |
| 2017/0370189 | A1 * | 12/2017 | MacDougall | E21B 34/14 |
| 2018/0371850 | A1 * | 12/2018 | McGarian | E21B 19/06 |

FOREIGN PATENT DOCUMENTS

| | | | |
|---|---|---|---|
| WO | WO 2017/182549 | A1 | 10/2017 |
| WO | WO 2018/203062 | A1 | 11/2018 |
| WO | WO 2018/203064 | A1 | 11/2018 |

OTHER PUBLICATIONS

European Patent Office as ISA, International Search Report for PCT/EP2020/053796; dated Apr. 30, 2020; eleven pages; European Patent Office, Rijswijk, The Netherlands.

* cited by examiner 10
16
14
18
28
52
20
66
62
22
23
12
11
24

10
16
18
14
11
30
20
66
62
12
24
11
21
22

10
16
14
18
28
20
66
62
22
12
11
21
24

10
16
14
18
28
52
20
66
62
22
12
23
11
21
24

10
16
14
18
28
52
30
20
66
62
22
23
26
11
21
24

10
16
68
18
60
28
30
14
20
66
62
22
23
12
26
52
64
11
21
24

WELL ABANDONMENT AND SLOT RECOVERY

BACKGROUND OF THE INVENTION

The present invention relates to apparatus and methods for well abandonment and slot recovery and in particular, though not exclusively, to a method of tuning elements of the bottom hole assembly in a vibratory casing recovery system to improve casing recovery.

When a well has reached the end of its commercial life, the well is abandoned according to strict regulations in order to prevent fluids escaping from the well on a permanent basis. In meeting the regulations it has become good practise to create the cement plug over a predetermined length of the well and to remove the casing. This provides a need to provide tools which can pull long lengths of cut casing from the well to reduce the number of trips required to achieve casing recovery. However, the presence of drilling fluid sediments, partial cement, sand or other settled solids in the annulus between the outside of the casing and the inside of a surrounding downhole body e.g. outer casing or formation can act as a binding material limiting the ability to free the casing when pulled. Stuck casings are now a major issue in the industry.

Traditionally, cut casing is pulled by anchoring a casing spear to its upper end and using the elevator/top drive on a drilling rig. However, some drilling rigs have limited pulling capacity, and when the casing may be stuck, there may be insufficient power at the spear to recover the stuck casing section. Consequently, further trips must be made into the well to cut the casing into shorter lengths for multi-trip recovery. As each trip into the well takes significant time and costs, techniques have been developed to reduce the number of trips into the well.

Vibration has been successfully used to assist in the removal of stuck objects in well bores. U.S. Pat. No. 7,077,205, the disclosure of which is incorporated herein in its entirety by reference, describes a method of freeing stuck objects from a bore comprising running a string into the bore, the string including a flow modifier, such as a valve, for producing variations in the flow of fluid through the string, and a device for location in the string and adapted to axially extend or contract in response to variations in the flow of fluid through the string. A portion of the string engages the stuck object. Fluid is then passed through the string while applying tension to the string, whereby the tension applied to the stuck object varies in response to the operation of the flow modifier and the extending or retracting device. This arrangement is offered as the Agitator™ to National Oilwell Varco, USA to assist in freeing a cut casing section when located below the casing spear.

A disadvantage in this approach is that the device which is adapted to axially extend or contract in response to variations in the flow of fluid is typically a shock sub which includes a spring. Those of skill in that art will note that shock subs are normally used for reducing shock and vibration-induced drilling string damage and bit wear. In such systems the spring is selected to provide a system having a natural frequency orders of magnitude lower than that of the frequency of vibrations expected to be experienced on the drill string. In this way, the vibrations experienced are a forcing frequency ($\Omega$) which induces vibration of the system at its natural frequency ($\omega$). Vibration theory teaches that the magnification ratio is at a maximum when $\Omega=\omega$ and the system resonates. In shock subs the frequency ratio is designed to be much greater than one so that the dynamic amplification factor of the system, DAF<<1 so that the vibration is significantly reduced as it travels up the string. Accordingly, while the Agitator™ creates a forcing frequency with an input amplitude, the shock sub will effectively reduce the output amplitude which determines the variation in tension applied to the stuck object, due to the low DAF, providing an inefficient transfer of energy from the flow modifier to the stuck object.

It is also known to use resonance to free stuck drill pipes and other objects in wellbores as all stuck tubulars exhibit resonant frequencies that are a function of the free length of the tubular. U.S. Pat. No. 6,009,948 describes a system for performing a suitable operation in a wellbore utilizing a resonator. The system includes a resonator for generating pulses of mechanical energy, an engaging device for securely engaging an object in the wellbore and a sensor for detecting the response of the object to pulses generated by the resonator. The resonator is placed at a suitable location in the wellbore and the engaging device is attached to the object. The resonator is operated at an effective frequency to induce pulses into the object. The sensor detects the response of the object to the induced pulses, which information is utilized to adjust the operating frequency. In such a system the resonator must be selected to have a sufficient frequency range and must be capable of switching frequencies in the wellbore. Further the system requires electrical connections so that the sensor can operate and feedback signals to the resonator to change frequency. Such a system is therefore expensive and requires trained technicians to operate at a well.

It is an object of the present invention is to provide a method for casing recovery in which one or more elements of the bottom hole assembly are tuned to maximise the tension variations on the cut section of casing by vibration of the bottom hole assembly to aid its release.

SUMMARY OF THE INVENTION

According to a first aspect of the present invention there is provided a method of casing recovery in a wellbore, comprising the steps;

(a) running a string into the wellbore, the string including a vibratory casing recovery bottom hole assembly, the vibratory casing recovery bottom hole assembly comprising:
  - a casing spear having a gripping mechanism to anchor the spear to casing to be recovered;
  - a flow modifier for producing cyclic variations at a first frequency in the flow of fluid through the string, and
  - one or more elements, the one or more elements including an extension and retraction means for location in the string and adapted to axially extend or contract in response to variations in the flow of fluid through the string;
  - and
  - the extension and retraction means being arranged between the casing spear and the flow modifier within the casing to be recovered;

(b) anchoring the casing spear to the casing to be recovered by use of the gripping mechanism;

(c) pumping fluid from surface through the string to produce cyclic variations at the first frequency in the flow of fluid through the string to induce vibration in and axially extend and contract the extension and retraction means;

(d) pulling the string and the vibratory casing recovery bottom hole assembly to recover the casing to be removed;

characterised in that:

at least one element is configured to have a natural frequency in the assembly when vibrated wherein:

$$0.6<\text{first frequency}/\text{natural frequency}<1.2.$$

In this way, elements of the bottom hole assembly are tuned to be at or near the frequency of the flow modifier so that the system operates near resonance. Preferably, such a system provides a DAF>1. Consequently there is a magnification of the amplitude of variation on the tension applied to the casing to be removed which aids casing recovery.

Preferably, the at least one element is configured to have a resonant frequency in the assembly when vibrated wherein:

$$0.9<\text{first frequency}/\text{resonant frequency}<1.1.$$

By making the natural or resonant frequency at or near the first frequency and thereby tuning the elements to the frequency of the flow modifier, the dynamic amplification factor of the bottom hole assembly is maximised thereby maximising the vibration experienced by the cut section of casing at the anchor point to the gripping mechanism.

The flow modifier may comprise an oscillating or rotating member, and is preferably in the form of a rotating valve, such as described in WO97/44565, the disclosure of which is incorporated herein by reference, although other valve forms may be utilised. The rotating valve may be driven by an appropriate downhole motor powered by any appropriate means, or a turbine, and most preferably by a fluid driven positive displacement motor (PDM).

The extension and retraction means preferably comprises a housing forming part of a string and containing a fluid flow or pressure actuated member and an oppositely acting biasing arrangement, fluid pressure or flow tending to actuate the member in one direction and the biasing arrangement acting in the opposite direction. Conveniently, the member is a piston and the biasing arrangement a spring; in the preferred arrangement an increase in pressure tends to move the piston in one direction, extending the housing, a decrease in fluid pressure allowing the spring to retract the housing. Those of skill in that art may recognise that these features may be found in downhole shock tools or shock absorbers, as normally used for reducing shock and vibration-induced drilling string damage and bit wear. They are also found in accelerators used for isolating the rig equipment from a downhole jarring force.

Preferably, the at least one element comprises the string and all tools suspended from the flow modifier wherein a length of the bottom hole assembly between the extraction and retraction means and an end of the string inside the casing to be recovered is selected to provide the natural frequency. More particularly, a weight of the bottom hole assembly between the extraction and retraction means and an end of the string inside the casing to be recovered is tuned to be near or at the first frequency. In this way, the mass of the bottom hole assembly below the extraction and retraction means will determine the amplitude variation in the vibration and thereby quantify the force of the cyclical loading on the casing to be removed at the anchor point.

Alternatively or additionally, the at least one element may be one or more pipe members arranged between the extension and retraction means and the casing spear wherein a length between the gripping mechanism and the extension and retraction means is selected to provide the natural frequency. In this way, the pipe members are tuned so as to transmit the maximum vibrational energy to the casing to be recovered at the anchor point.

Preferably, the pipe members may be drill collars. Alternatively, the pipe members may be drill pipe and more preferably a heavy-weight drill pipe.

The method may include providing a downhole pulling tool on the string above the vibratory casing recovery bottom hole assembly and using the downhole pulling tool to pull the vibratory casing recovery bottom hole assembly and casing to be recovered before pulling the string to recover the casing. In this way, a high static load can be applied to the casing to be recovered which in turn increases the dynamic amplification factor to further increase pulling capacity.

The method may include the additional steps of providing a casing cutter in the vibratory casing recovery bottom hole assembly and cutting casing to provide a cut section of casing to be removed on the same trip as recovering the casing.

Accordingly, the drawings and descriptions are to be regarded as illustrative in nature, and not as restrictive. Furthermore, the terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

All numerical values in this disclosure are understood as being modified by "about". All singular forms of elements, or any other components described herein including (without limitations) components of the apparatus are understood to include plural forms thereof.

It is also realised that terms such as 'above' and below' are relative and while the description assumes a perfectly vertical wellbore, the invention can be used on deviated wellbores.

BRIEF DESCRIPTION OF THE DRAWINGS

Embodiments of the present invention will now be described, by way of example only, with reference to the accompanying drawings of which.

DETAILED DESCRIPTION OF THE INVENTION

Figures 1A, 1B, 1C, 1D, 1E, 1F:
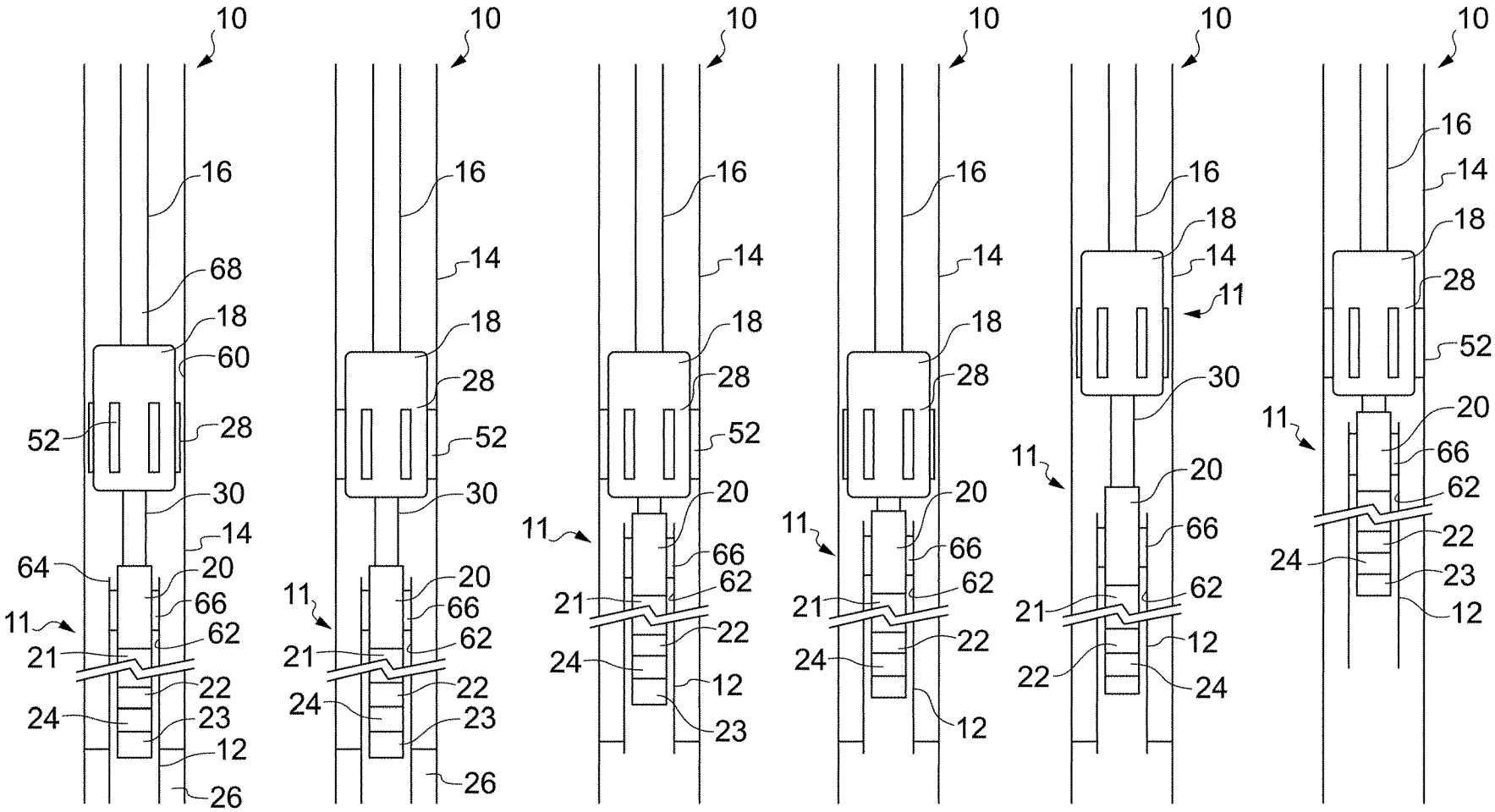
FIGS. 1(*a*) to 1(*f*) illustrate apparatus and method for casing recovery in a wellbore, using a vibratory casing recovery bottom hole assembly, according to an embodiment of the present invention.

Reference is initially made to FIG. 1 of the drawings which illustrates a method of recovering casing from a well using a vibratory casing recovery bottom hole assembly, according to an embodiment of the present invention. In FIG. 1(*a*) there is shown a cased well bore, generally indicated by reference numeral 10, in which a length of casing 12 requires to be recovered. A tool string 16 including a vibratory casing recovery bottom hole assembly 11 is run in the well 10. Apparatus 11 includes a casing spear 20, a shock sub 22 and a flow modifier 24 arranged in order on the bottom of the drill string 16. Optionally, a number of drill collars 21 (one shown) can be located between the casing spear 20 and the shock sub 22; a downhole pulling tool 18 can be located above the casing spear 20; and a casing cutter 23 located below the flow modifier 24. Other elements such as a pressure drop sub may also be located on the string 16 and form part of the vibratory casing recovery bottom hole assembly 11.

The tool string 16 is a drill string typically run from a rig (not shown) via a top drive/elevator system which can raise and lower the string 16 in the well 10. The well 10 has a second casing 14. Casing 14 has a greater diameter than casing 12. In an embodiment, length of casing 12 is 9⅝" diameter while the outer casing is 13⅜" diameter.

Casing 12 will have been cut to separate it from the remaining casing string. In an embodiment the vibratory casing recovery bottom hole assembly 11 includes a casing cutter 23 and the casing 12 is cut on the same trip into the well 10 as that to recover it. The cut section of casing 12 may be over 100 m in length. It may also be over 200 m or up to 300 m. Behind the casing 12 there may be drilling fluid sediments, partial cement, sand or other settled solids in the annulus between the outside of the casing 12 and the inside of a surrounding downhole body, in this case casing 14 but it may be the formation of the well 10. This material 26 can prevent the casing 12 from being free to be pulled from the well 10. It is assumed that this is the position for use of the present invention.

Casing spear 20 operates to grip the inner surface 62 of the length of casing 12. The casing spear anchors via a gripping mechanism being slips 66 designed to ride up a wedge and by virtue of wickers or teeth on its outer surface grips and anchors to the inner surface 62 of the casing 12. The casing spear 20 includes a switch which allows the casing spear to be inserted into the casing 12 and hold the slips in a disengaged position until such time as the grip is required. At this time, the casing spear 20 is withdrawn from the end 64 of the casing 12 and, as the switch exits the casing 12, it automatically operates the slips which are still within the casing 12 at the upper end 64 thereof. This provides the ideal setting position of the spear 20. In a preferred embodiment the casing spear 20 is the Typhoon® Spear as provided by Ardyne AS. The Typhoon® Spear is described in WO2017/059345, the disclosure of which is incorporated herein in its entirety by reference.

The flow modifier 24 is a circulation sub which creates fluid pulses in the flow passing through the device. This can be achieved by a rotating member or a rotating valve. In the embodiment shown the flow modifier 24 contains a positive displacement motor (PDM) and a rotating valve, such as described in WO97/44565, the disclosure of which is incorporated herein by reference. The valve includes a valve member which is rotated or oscillated about a longitudinal axis by the PDM and in doing so varies the flow area of the valve. This creates a cyclical or periodic variation in the fluid flow at a frequency. This frequency is determined by the size of plates or valve members and is typically 15 to 20 Hz.

Figure 2:
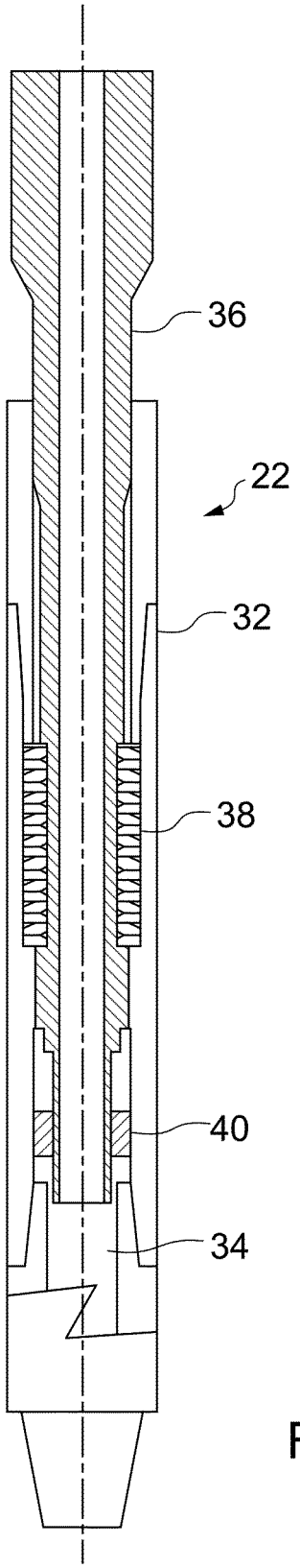
FIG. 2 is a schematic sectional view of a shock tool of the apparatus of FIG. 1.

Above the flow modifier 24 is a shock sub 22, as is illustrated in greater detail in FIG. 2, comprising a body 32 defining a cylinder 34 and which is mounted to the flow modifier 24, and a piston member 36 which is mounted to the string 16. The piston member 36 is coupled to the body 32 via a spring 38 which limits the degree of relative axial movement between the member 36 and the body 32. The lower end of the piston member 36 extends into the cylinder 34 and carries a floating piston 40. The volume above the piston 40 accommodates oil which serves to lubricate the spring 38 and the movement of the piston member 36 relative to the body 32, and any changes in oil volume due to temperature variations are accommodated by movement of the piston 40. A higher fluid pressure within the sub 22, as would occur when the rotating valve was restricting the flow of fluid below the sub, tends to urge the piston member 36 out of the upper end of the body 32, and thus the sub 22 to extend, while a lower pressure allows the spring to retract the sub 22 to a median configuration.

In a preferred embodiment the flow modifier 24 is the Agitator™ System available from National Oilwell Varco. It is described in U.S. Pat. No. 6,279,670, the disclosure of which is incorporated herein in its entirety by reference. The use of the flow modifier 24 with a shock sub 22 is described in U.S. Pat. No. 7,077,295, the disclosure of which is incorporated herein in its entirety by reference. In U.S. Pat. No. 7,077,295, the cyclic variation in the flow modifier is used to induce an axial variation in the shock sub at the same frequency. However, the spring 38 will have its own natural frequency or resonant frequency determined by its design (spring constant) and the mass it carries. In standard shock subs used to reduce the transmission of vibrations up a drill string, the spring is deliberately selected so that the natural or resonant frequency ($\omega$) is far away, typically at least 20 times, different than that of the frequency of vibration, forced frequency ($\Omega$) expected to be experienced. In the present invention, the reverse is the case.

In the present invention we can consider the shock sub 22 and the tools suspended from it as a spring-mass system. This system will have a natural frequency, $\omega$. Standard vibration theory gives a relationship of:

$$\omega=(1/2\pi)\times(k/m)^{0.5}$$

were k is the stiffness of the spring and m is the mass of the suspended tools. When the system is subjected to a forced frequency $\Omega$, being the frequency of the cyclic variation in flow through the flow modifier 24, the amplitude of vibrations in the system will be determined from the magnification ratio M and the damping ratio $\zeta$, according to the classic relationship:

$$M=1/\{[1-(\Omega/\omega)^2]^2+4\zeta^2(\Omega/\omega)^2\}^{1/2}$$

Figure 3:
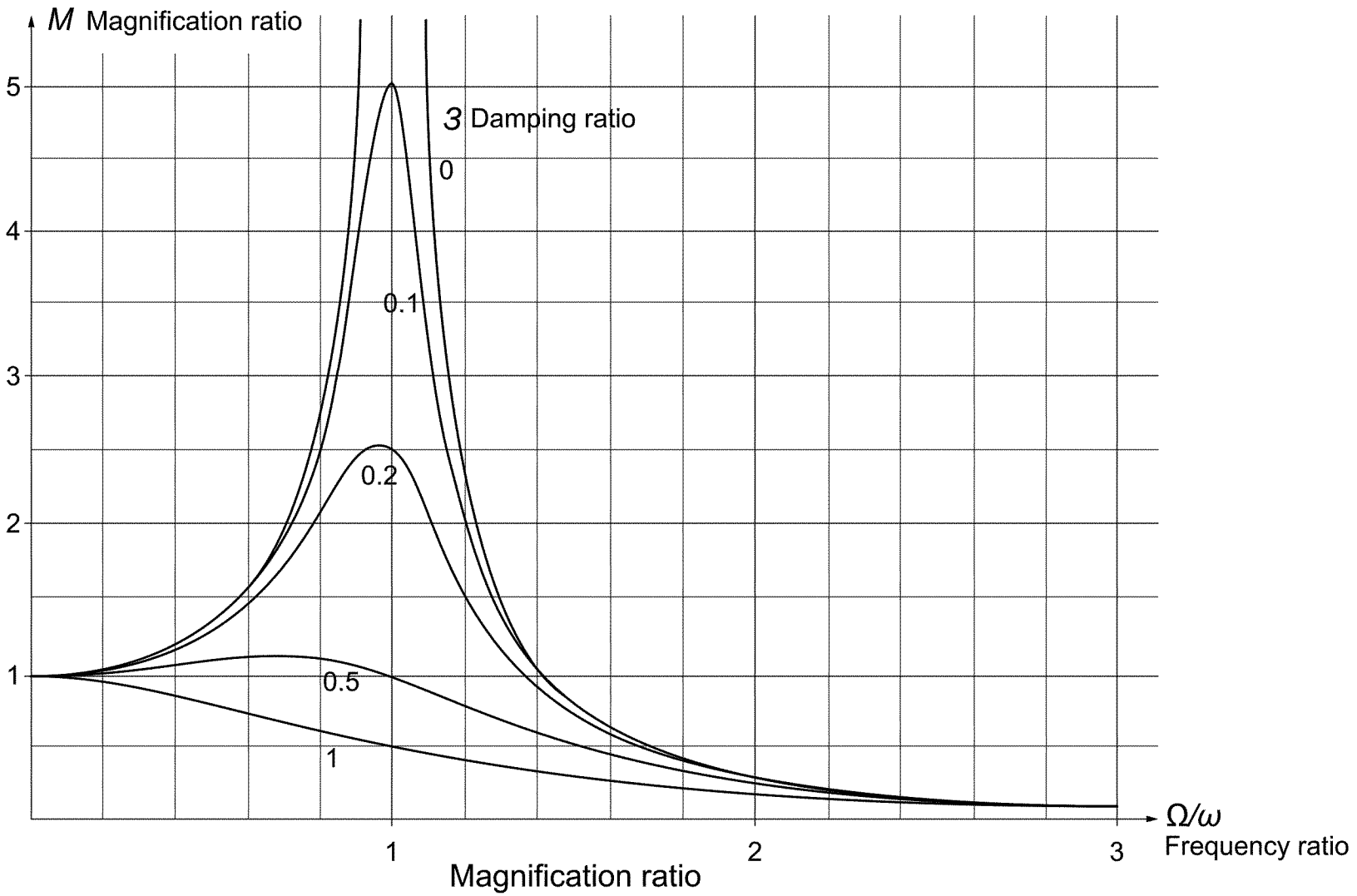
FIG. 3 is an illustrative graph of frequency ratio ($\Omega/\omega$) versus magnification factor (M) for a range of damping ratios ($\zeta$).

This is shown in FIG. 3 graphed as frequency ratio ($\Omega/\omega$) versus magnification factor M for varying damping ratios $\zeta$.

The flow modifier 24 will provide the forced frequency $\Omega$ in operation. This is typically 15 and 20 Hz for the Agitator™ supplied by NOV. The shock sub 22 and tools 24, 23 suspended from it on the string 16, are designed to provide a natural frequency $\omega$, wherein the frequency ratio $\Omega/\omega$ is close to 1. The frequency ratio may be between 0.6 and 1.2. It can be seen that for a damping ratio, $\zeta=0$, the magnification ratio M=>1.6. Thus the amplitude of the vibration from the flow modifier 24, is magnified by at least 1.6 upon the system. In an embodiment, the frequency ratio is between 0.9 and 1.1. Therefore by tuning the system of the bottom hole assembly, to be close to or at the output frequency of the flow modifier, the system can be near or at resonance, causing a magnification of the amplitude of the vibration on the system.

As shown in FIG. 1(*a*) the casing spear 20 is anchored to the cut casing section 12 by slips 66. The shock sub 22 is mounted below the casing spear 20 being separated from the casing spear 20 by one or more drill collars 21, if desired. As the string 16 is raised, flow through the string 16 and assembly 11 via a throughbore 68 will operate the flow modifier 24 and induce movement in the shock sub 22 and the system will vibrate at a natural frequency near or equal to forcing frequency from the flow modifier 24. Consequently, the dynamic load applied at the anchor point where the slips 66 grip the casing 12, is maximised as the tension varies on the casing 12 at near resonance. The dynamic amplification factor ((dynamic load+static load)/(static load)) is therefore also maximised with the result that the maximum vibratory energy that can be created by the shock sub 22 is transmitted to the casing spear and onto the casing 12. The movement induced on the casing 12 by the vibration is used in dislodging the stuck material 26 to free the casing 12 and so aid recovery of the casing 12.

In the embodiment shown the string 16 also comprises a hydraulic jack 18. The hydraulic jack 18 is located above the casing spear 20 and a pressure drop sub may be located below the casing cutter 23 form part of the vibratory casing recovery bottom hole assembly 11.

The hydraulic jack 18 has an anchor 28 and an actuator system which pulls an inner mandrel 30 up into a housing of the jack 18. In a preferred embodiment the hydraulic jack is the DHPT available from Ardyne AS. It is described in U.S. Pat. No. 8,365,826, the disclosure of which is incorporated herein in its entirety by reference.

The anchor 28 of the jack 18, like the casing spear 20, has a number of slips 52 which are toothed to grip an inner surface 60 of the casing 14.

A pressure drop sub or valves can be used to create a build-up of fluid pressure in the throughbore 68 when fluid is pumped down the string 16. This is used to create pressure at the jack 18 for operating the hydraulic jack 18.

In a casing recovery operation, the string 16 is run into the well 10 with the flow modifier 24, shock sub 22, drill collars 21 and casing spear 20 being run-in the casing 12. The string 16 is raised to a position to operate the switch on the casing spear 20 and the slips 66 automatically engage the inner surface 62 of the casing 12 at the upper end 64 thereof. At this stage the string 16 can be pulled via the top drive/elevator to see if the casing 12 is stuck. Fluid pumped down the string 16 will operate the flow modifier 24 and create vibration of the bottom hole assembly 11. As the shock sub 22 is tuned to be at or near the frequency of the output of the flow modifier 24, an enhanced vibratory force will be experienced by the cut section of casing 12. Raising the string 16 can be done again to see if the material 26 has been dislodged sufficiently to allow the casing 12 to be recovered. If the casing 12 still does not move then the downhole pulling tool i.e. jack 18 is operated.

Referring now to FIG. 1(*b*), slips 52 on the anchor 28 of the hydraulic jack 18 are operated to engage the inner surface 60 of the outer casing 14. As with the casing spear 20, an overpull on the string 16 will force the teeth on the slips into the surface 60 to provide anchoring.

With fluid flowing down a throughbore 68 of the string 16, the pressure of the fluid will build up by virtue of restrictions at nozzles of the pressure drop sub. At the same time, the fluid flow through the flow modifier 24 will create pressure pulses seen as a cyclic variation of pressure and consequently applied load via the shock sub 22. The flow modifier 24 provides output at a frequency of less than 20 Hz and preferably between 15 and 20 Hz. The shock sub 22 is induced to oscillate at this frequency and as it closely matches the natural frequency of the sub 22 and tools suspended therefrom it will resonate the bottom hole assembly 11 causing periodic or cyclical loading on the casing 12 via the slips 66 of the casing spear 20. The amplitude of the cyclic variations can be selected via the spring load on the shock sub 22 due to the mass of elements in the string 16 below the shock sub 22 to determine the axial extent of the oscillatory movement on the assembly 11 and casing 12.

Build up of fluid pressure at the hydraulic jack 18 creates a fluid pressure which is sufficient to move inner pistons within the jack, so forcing the inner mandrel 30 upwards into the housing 32. As the inner mandrel 30 is connected to the casing spear 20 which is in turn anchored to the length of casing 12, the force on the length of casing will match the applied load of the pressure. This force is a large static load used to raise the assembly 11 and cut section of casing 12 and should be sufficient to release the casing 12 and allow it to move. At the same time, the casing 12 will vibrate or axially oscillate at the or near the resonant frequency by virtue of the shock sub 22 and tools suspended therefrom, being tuned to the output frequency of the flow modifier 24. Such vibration has been shown to assist in releasing stuck casing and thus this action can assist during the pulling of the casing 12 by the jack 18. Note that the high static load applied by the hydraulic jack 18 does not decrease the dynamic amplification factor DAF=((dynamic load+static load)/(static load). For the system with only a static load, DAF<<1. In the present invention, DAF>1.

It is hoped that the jack 18 can make a full stroke to give maximum lift to the casing 12. This is illustrated in FIG. 1(*c*). If the casing 12 is still stuck only a partial stroke will be achieved. In either case, the anchor 28 is unset, by setting down weight, as shown in FIG. 1(*d*).

Raising the string 16 will now lift the housing 32 with respect to the inner mandrel 30, to re-set the jack 18 in the operating position as illustrated in FIG. 1(*a*). This is now shown in FIG. 1(*e*) with the casing 12 now raised in the casing 14. As the string 16 is raised, the casing 12 may be free and then the entire apparatus 11 and the length of casing 12 can be recovered to surface and the job complete.

If the casing 12 remains stuck, the anchor 28 is re-engaged as illustrated in FIG. 1(*f*) and the steps repeated as described and shown with reference to FIGS. 1(*b*) to 1(*e*). The steps can be repeated any number of times until the length of casing 12 is free and can be pulled to surface by raising the string 16 using the top drive/elevator on the rig.

As long as fluid is pumped down the throughbore 68, the flow modifier 24 and shock sub 22 will operate and resonant axial movement is induced in the assembly 11 to aid casing removal.

It will be appreciated by those skilled in the art that the use of the hydraulic jack 18 and pressure drop sub 24 is optionally and the casing 12 may be recovered using only the casing spear 20 with the flow modifier 24 and shock sub 22 in the bottom hole assembly 11. Additionally, any devices which cause periodic axial loading on the anchor point can be used as the flow modifier 24 and shock sub 22.

In a further embodiment, a length of connecting pipe is provided between the casing spear 20 and the shock sub 22. This connecting pipe may be formed as one or more drill collars 21 or lengths of drill pipe which may be heavy weight drill pipe. The distance between the anchor point of the slips 66 and the shock sub 22, can be adjusted by increasing and decreasing the length of drill collars 21. This length can be set to create resonance along the drill collars which is at a natural resonant frequency equal to the frequency of the output of the flow modifier 24. By tuning this element of the bottom hole assembly 11, the dynamic amplification factor can be maintained as the maximum vibrational energy is transmitted with the minimum losses to the casing 12.

The principle advantage of the present invention is that it provides a method of recovering longer lengths of casing by tuning the tuning elements of the bottom hole assembly to the frequency output of a fluid modifier.

A further advantage of the present invention is that it provides a method of vibratory enhanced casing recovery which increases cyclical loading on the casing to help dislodge material behind the casing.

The foregoing description of the invention has been presented for the purposes of illustration and description and is not intended to be exhaustive or to limit the invention to the precise form disclosed. The described embodiments were chosen and described in order to best explain the principles of the invention and its practical application to thereby enable others skilled in the art to best utilise the invention in various embodiments and with various modifications as are suited to the particular use contemplated. Therefore, further modifications or improvements may be incorporated without departing from the scope of the invention herein intended with the invention being defined within the scope of the claims.

We claim:

1. A method of casing recovery in a wellbore, comprising the steps;

(a) running a string into the wellbore, the string including a vibratory casing recovery bottom hole assembly, the vibratory casing recovery bottom hole assembly comprising:

a casing spear having a gripping mechanism to anchor the spear to casing to be recovered;

a flow modifier for producing cyclic variations at a first frequency in the flow of fluid through the string, and one or more elements, the one or more elements including an extension and retraction means for location in the string and adapted to axially extend or contract in response to variations in the flow of fluid through the string; and the extension and retraction means being arranged between the casing spear and the flow modifier within the casing to be recovered;

(b) anchoring the casing spear to the casing to be recovered by use of the gripping mechanism;

(c) pumping fluid from surface through the string to produce cyclic variations at the first frequency in the flow of fluid through the string to induce vibration in and axially extend and contract the extension and retraction means;

(d) pulling the string and the vibratory casing recovery bottom hole assembly to recover the casing to be removed;

characterised in that:

at least one element is configured to have a resonant frequency in the assembly when vibrated wherein:

$0.6<\text{first frequency}/\text{resonant frequency}<1.2$.

2. The method of casing recovery in a wellbore according to claim 1 wherein at least one element is configured to have a resonant frequency in the assembly when vibrated wherein:

$0.9<\text{first frequency}/\text{resonant frequency}<1.1$.

3. The method of casing recovery in a wellbore according to claim 1 wherein the extension and retraction means comprises a housing forming part of the string and containing a fluid actuated member and an oppositely acting biasing arrangement, fluid force tending to actuate the member in one direction and the biasing arrangement acting in the opposite direction.

4. The method of casing recovery in a wellbore according to claim 3 wherein the fluid actuated member is a piston and the biasing arrangement a spring.

5. The method of casing recovery in a wellbore according to claim 1 wherein the at least one element comprises the string and all tools suspended from the flow modifier wherein a length of the bottom hole assembly between the extraction and retraction means and an end of the string inside the casing to be recovered is selected to provide the resonant frequency.

6. The method of casing recovery in a wellbore according to claim 1 wherein the at least one element includes one or more pipe members arranged between the extension and retraction means and the casing spear wherein a length between the gripping mechanism and the extension and retraction means is selected to provide the resonant frequency.

7. The method of casing recovery in a wellbore according to claim 1 wherein the first frequency is between 15 Hz and 20 Hz.

8. The method according to claim 1 wherein the method includes providing a downhole pulling tool on the string above the vibratory casing recovery bottom hole assembly and using the downhole pulling tool to pull the vibratory casing recovery bottom hole assembly and casing to be recovered before pulling the string to recover the casing.

9. The method according to claim 1 wherein the method includes the additional steps of providing a casing cutter in the vibratory casing recovery bottom hole assembly and cutting casing to provide a cut section of casing to be removed on the same trip as recovering the casing.

* * * * *